US008177107B2

(12) United States Patent
Kecskes

(10) Patent No.: US 8,177,107 B2
(45) Date of Patent: May 15, 2012

(54) BELT CLIP ATTACHMENT APPARATUS AND METHOD FOR MOBILE PHONE OR THE LIKE

(75) Inventor: Adam Kecskes, San Diego, CA (US)

(73) Assignee: KYOCERA Corporation, Kyoto (JP)

( * ) Notice: Subject to any disclaimer, the term of this patent is extended or adjusted under 35 U.S.C. 154(b) by 1360 days.

(21) Appl. No.: 11/386,119

(22) Filed: Mar. 20, 2006

(65) Prior Publication Data

US 2010/0270345 A1 Oct. 28, 2010

(51) Int. Cl.
*A01K 97/04* (2006.01)
*A45F 5/00* (2006.01)

(52) U.S. Cl. ..... 224/197; 224/930; 224/271; 224/663; 224/669

(58) Field of Classification Search ..... 224/197, 224/269, 930, 904, 185, 196, 198–200, 600, 224/663, 666–669, 268, 549, 271; 248/682, 248/690, 685, 309.2; 24/3.11, 3.12
See application file for complete search history.

(56) References Cited

U.S. PATENT DOCUMENTS

| | | | | |
|---|---|---|---|---|
| 2,491,629 | A * | 12/1949 | Vernier et al. | 52/111 |
| 4,685,237 | A * | 8/1987 | Hugg | 42/85 |
| 5,507,423 | A * | 4/1996 | Fischer et al. | 224/313 |
| 5,906,031 | A * | 5/1999 | Jensen | 24/3.12 |
| 6,305,588 | B1 * | 10/2001 | Michel et al. | 224/271 |
| 6,364,184 | B1 | 4/2002 | Hauck et al. | |
| 2005/0040192 | A1 | 2/2005 | Steven, III et al. | |

* cited by examiner

*Primary Examiner* — Nathan J Newhouse
*Assistant Examiner* — Corey Skurdal

(57) ABSTRACT

A retractable belt clip button is slidably engaged in a recess in the rear face of the housing of a mobile phone or other portable electronic device for movement between an extended position projecting out of the rear face of the housing and a retracted position in which an outer face of the button is substantially flush with the rear face of the housing. A spring biases the button into the extended position. A push button latching mechanism is provided for releasably holding the button in the retracted position when it is pushed into the recess, and the latching mechanism is released when a user pushes the button inwardly from the latched position, allowing the button to pop out into the extended position under the action of the biasing spring.

19 Claims, 2 Drawing Sheets

BELT CLIP ATTACHMENT APPARATUS AND METHOD FOR MOBILE PHONE OR THE LIKE

FIELD OF THE INVENTION

The present invention relates generally to the field of mobile phones or other personal electronic devices, and is particularly concerned with a belt clip attachment device for attaching a mobile phone or the like to a belt clip.

BACKGROUND OF THE INVENTION

Portable communication devices such as mobile phones, personal digital assistants (PDA) and the like are often carried on a belt, strap or similar location for easy access. This typically requires the use of a holster, pouch, or clip. Holsters and pouches tend to be unwieldy, sticking out from the user's hip or attached to the belt of a woman's purse. This means that the holster or pouch, and the attached electronic device, could potentially be knocked off or damaged, and also makes such devices uncomfortable and obtrusive.

Clips tend to be less obtrusive as far as the user is concerned. Typically, these devices have a hook or clip on the back face for attachment to a belt or strap, and a channel on the front face for attaching to the mobile phone or other electronic device. Such devices will lie relatively flat against the belt or strap. However, these devices affect the form factor of the phone or other device to be attached to the clip, since they require a button or "wart" to protrude from the rear face of the phone which is engaged in the channel when the phone is to be attached to the clip. The button is either placed permanently on the rear face of the phone during manufacturing or is supplied separately to be affixed to the back of the phone by adhesive tape. The button prevents the phone from being placed level on a flat surface, and can also be inconvenient if the user wishes to carry the phone or other portable electronic device in a pocket or purse. The protruding button also forces the user to change the way they hold the phone or device when in use.

SUMMARY OF THE INVENTION

It is an object of the present invention to provide a new and improved belt clip attachment device for releasably attaching a mobile phone or other portable electronic device to a belt clip.

According to one aspect of the present invention, a belt clip attachment apparatus is provided, which comprises a personal electronic device having an outer housing with a rear face, a recess in the rear face of the housing, and a button mounted in the recess for movement between a first, extended position projecting out of the rear face of the housing and a second, retracted position in which an outer face of the button is substantially flush with the rear face of the housing, the recess and button having interengageable formations for releasably retaining or latching the button in the retracted position, and a biasing member in the recess for biasing the button into the extended position In an exemplary embodiment of the invention, the interengageable formations are similar to the known push button latching mechanism of ballpoint pen actuators, and have a push-to-engage and push-to-release action. Other possible interengageable formations may comprise threaded engagement means or a snap on retainer at the outer end of the recess.

The button may comprise a post or column with an enlarged head at each end, and the recess comprises a bore of slightly larger diameter than the enlarged heads so that the button is a close sliding fit in the bore. The biasing member comprises a spring located between the inner end of the bore and the inner end of the button. Any suitable push-to-release latching mechanism may be provided for releasably retaining the button in the retracted position and allowing the button to pop out into the extended position if it is first pushed inwardly. The enlarged outer head of the button is designed for releasable sliding engagement in the channel of a belt clip when in the extended position.

According to another aspect of the present invention, a method of releasably securing a portable electronic device to a belt clip is provided, comprising the steps of:

releasing a button from a latched position in a mating bore in the rear face of a portable electronic device so that it pops out of the bore into an extended position;

engaging an enlarged head at the outer end of the push button in a channel of a belt clip and sliding the head along the channel into an end position in which the head is releasably held in the channel; and sliding the enlarged head out of the channel when the portable electronic device is to be used, and pushing the outer end of the push button inwardly into the bore until a latching mechanism in the bore is in latching engagement with the push button to releasably retain the push button in a retracted position located completely within the bore.

In the exemplary embodiment of the invention, the step of releasing the button from the bore comprises pushing the outer end of the button inwardly into the bore and releasing it so that it is urged out of the bore into an extended position by a biasing spring. The outer head of the button in the extended position is designed for releasable sliding engagement in a channel of a standard belt clip or similar device. When the user wishes to remove the phone or other portable device from the belt clip for use, they can simply retract the button into the recess or bore in the rear face of the device. This will make the button flush with the back of the phone, removing it from view. When retracted into the bore, the button does not protrude from the phone against the palm of the user's hand, which would potentially cause discomfort to the user. The phone can be readily placed back on its clip simply by pressing the top of the button and allowing it to pop up from its previously hidden position.

BRIEF DESCRIPTION OF THE DRAWINGS

The present invention will be better understood from the following detailed description of some exemplary embodiments of the invention, taken in conjunction with the accompanying drawings, in which like reference numerals refer to like parts, and in which.

DETAILED DESCRIPTION OF THE EXEMPLARY EMBODIMENT

Figures 1, 2, 3:
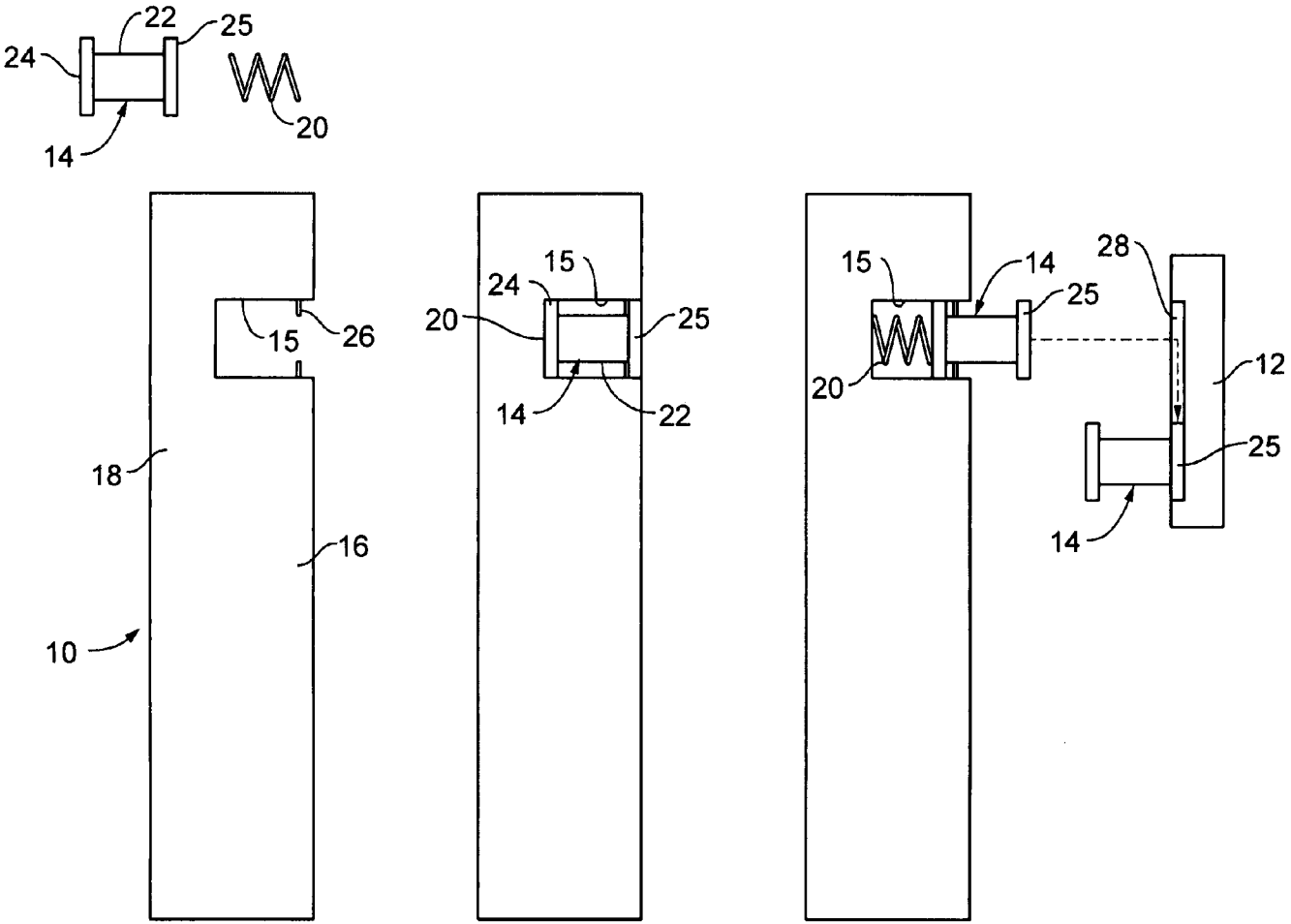
FIG. 1 is an exploded diagrammatic view of the components of a belt clip attachment apparatus according to an exemplary embodiment of the invention.
FIG. 2 is a view similar to FIG. 1 illustrating the assembled components with the button in a retracted position in the housing.
FIG. 3 is a view similar to FIG. 2 with the button in the projecting, extended position, with the arrow indicating how the projecting head of the button my be engaged in a belt clip channel.

FIGS. 1 to 3 illustrate a belt clip attachment apparatus according to an exemplary embodiment of the present invention for releasably attaching a mobile phone 10 or other portable electronic device to a belt clip 12. The apparatus basically comprises a button 14, a button receiving recess or bore 15 which is built into the rear face 16 of a mobile phone housing 18 or the rear face of the housing of any portable electronic device, and a spring or biasing mechanism 20.

The button is similar to known belt clip buttons which are currently secured permanently to the rear faces of portable electronic devices such as mobile phones to allow such devices to be carried on a belt clip. Button 14 has a shaft or column 22 with an enlarged head 24, 25 at each end. The bore 15 is of diameter slightly greater than that of the enlarged heads 24, 25, so that the button is a close sliding fit in the button housing or bore. The bore can be built into the rear wall of any conventional mobile phone housing at a suitable location where it will not interfere with internal electronics or the like inside the housing. Alternatively, a separate cup-like member for forming bore 15 may be secured in a hole in the rear wall of a portable electronic device or phone. The button is mounted in the bore as indicated in FIGS. 2 and 3, with the spring located between the inner end 26 of the bore and the inner end or head 24 of the button. The button 14 is movable between the retracted position of FIG. 2 where the outer face of outermost head 25 of the button is substantially flush with the rear face of the phone, and the projecting or extended position of FIG. 3, where the outermost head 25 extends out of the bore and projects from the rear face of the phone.

A releasable retainer mechanism is provided for releasably securing the button in the retracted position until it is needed to secure the phone to a belt clip. Any suitable retainer mechanism between the push button and bore may be used, such as a latching push button mechanism as illustrated in the drawings, a screw threaded engagement between the push button and bore, a snap on retainer at the outer end of the bore, or the like. In the illustrated embodiment, the latching push button mechanism releasably retains the button 14 in the retracted position of FIG. 2. This mechanism is similar to the known type of push button latching mechanism commonly used on ball-point pens. This is illustrated schematically in the drawings as a latching projection 26 in bore 15 adjacent the outer end of the bore. The outermost head 25 of the button 14 will have a mating indent (not illustrated in the drawings) which snaps into engagement with the projection 26 when the button is pushed into the body of the phone by the user. Pushing the button inwardly from the position of FIG. 2 and releasing it will release the snap engaging formations and cause the button to snap out of the bore under the action of biasing spring 20. The inner end of the button is retained in the bore by the spring 20, to which it may be attached, and by the latching mechanism 26 which will prevent the head 24 from sliding all of the way out of the channel.

Figure 4:
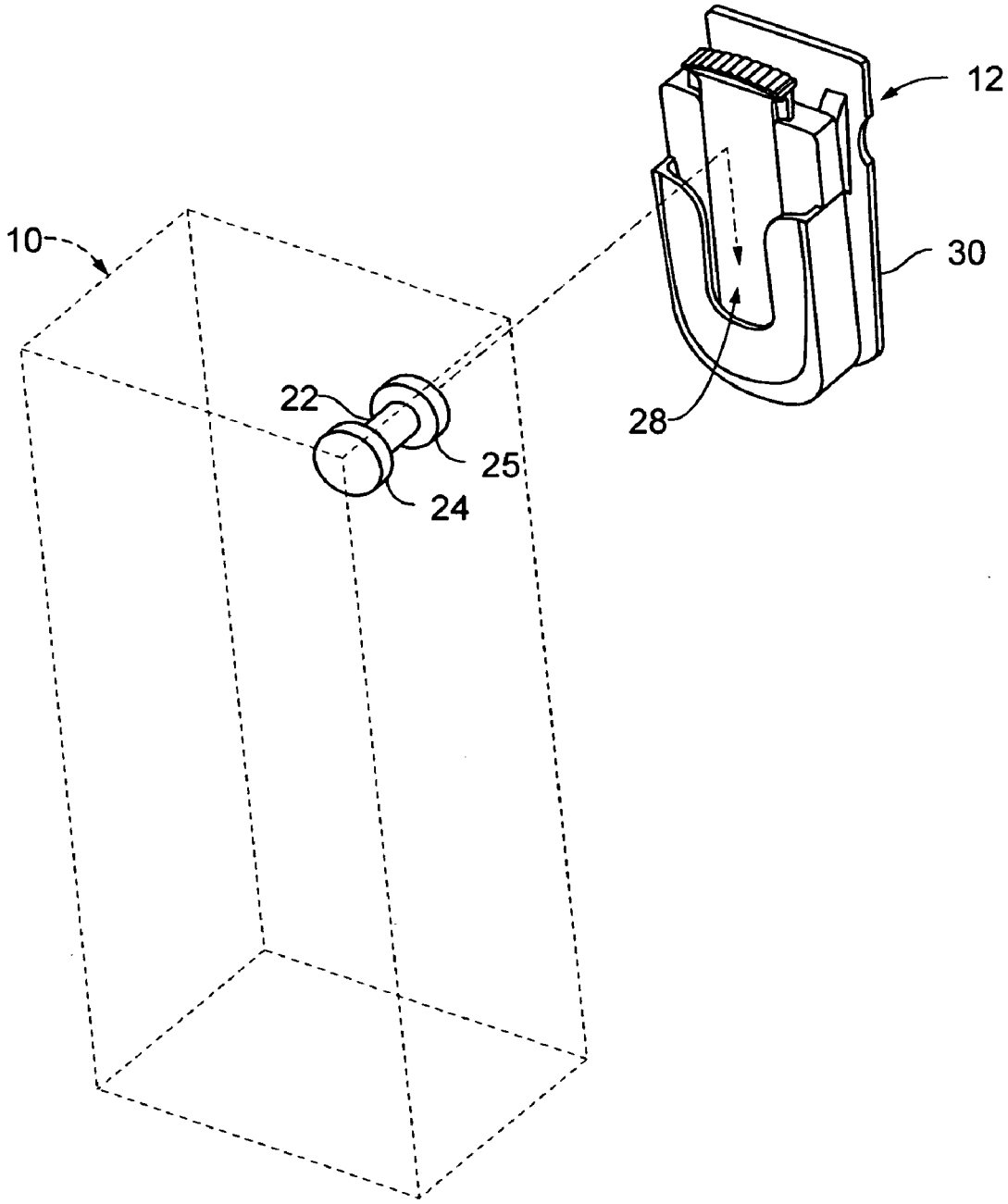
FIG. 4 is a perspective view of the button and an exemplary belt clip.

FIG. 4 illustrates an exemplary belt clip device 12 with which the retractable belt clip button mechanism of this invention may be used. The belt clip device 12 will have a clip 30 on its rear face for clipping onto a belt, waist band, pocket, strap, or the like, and has a channel 28 on its front or exposed face for receiving a button. When the retractable button 14 is in the extended or popped out position of FIG. 3, the head 25 can be engaged in the channel and slides down into the lower end of the channel, holding the button and the attached phone or device onto the belt clip as indicated in FIGS. 3 and 4. It will be understood that the button may be used with any belt clip having a receiving channel, and not only with a belt clip having the form of FIG. 4. The enlarged head 25 of the button may have formations for releasable engagement with matching formations in the base of channel 28, and may be similar to the dimpled head of a known dimpled hub, for example.

The retractable belt clip button will be held in the retracted position recessed into the phone housing when not in use, with the outer face of the button 25 flush with the rear face of the phone housing so that it does not protrude or detract from the external appearance of the phone. The outer face of head 25 may be designed to match that of the surrounding face of the phone housing, both in color and surface texture, so that the button is essentially "hidden" when in the retracted position. When the user wishes to place the phone onto a belt clip, they simply depress the button into the housing with their thumb and then release it, allowing the button to pop up from its hidden position under the action of biasing spring 20. It can then easily be engaged with the belt clip channel as indicated in the manner shown in FIGS. 3 and 4 so that it can be conveniently carried in a readily accessible position when desired for use. When the user wishes to use the phone, they simply release the button from the channel and press the head 25 of button 14 inwardly, compressing the spring 20 and engaging the latching mechanism 26. The phone is now ready for use.

Although an exemplary embodiment of the invention has been described above by way of example only, it will be understood by those skilled in the field that modifications may be made to the disclosed embodiment without departing from the scope of the invention, which is defined by the appended claims.

What is claimed is:

1. A method of releasably securing a portable electronic device to a belt clip comprising:

releasing an integrally made and retracted push button from a latched position internal to the portable electronic device by activating a ball point pen push button latching mechanism in a mating bore disposed in a rear face of the portable electronic device so that the integrally made push button pops out of the mating bore into an extended position making an enlarged head on the integrally made push button accessible;

engaging the enlarged head on the integrally made push button in a channel of the belt clip and sliding the enlarged head on the integrally made push button along the channel into an end position in which the enlarged head on the integrally made push button is releasably held in the channel;

sliding the enlarged head on the integrally made push button out of the channel when the portable electronic device is to be used; and pushing the outer end of the push button on the integrally made push button longitudinally inwardly into the mating bore until the ball point pen push button latching mechanism in the mating bore is in latching engagement with the integrally made push button, to releasably retain the integrally made push button in a retracted position in the mating bore disposed in the housing.

2. The method as claimed in claim 1, wherein releasing the push button from the latched position further comprises:

pushing the outer end of the push button inwardly until the push button is released from the push button latching mechanism; and releasing the push button by activating the push button latching mechanism so the push button is biased outwardly into the extended position by a biasing member between an inner end of the push button and an inner end of the bore.

3. A method of securing a portable electronics device comprising:

disposing a bore in a rear face of an electronics device;

disposing a retractable push button in the bore;

providing biasing for extending the retractable push button so that an outermost head of the retractable pushbutton extends out of the bore;

providing a belt clip having a channel for sliding the outermost head of the retractable pushbutton into the channel; and providing indents in the outermost head to couple to mating latching projections in the bore so that the retractable push button may be hidden in the bore when the outermost head is not coupled to the belt clip.

4. The method of securing a portable electronics device of claim 3, in which biasing is by a spring.

5. The method of securing a portable electronics device of claim 3, further comprises providing a inner button to retain the retractable push button in the bore.

6. The method of securing a portable electronics device of claim 5, in which retention is provided by the latching projection.

7. The method of securing a portable electronics device of claim 6, in which the latching projection snaps into engagement with the indents.

8. The method of securing a portable electronics device of claim 3, in which the retractable push button is constructed as a push button latching mechanism used in a ball point pen.

9. The method of securing a portable electronics device of claim 8, in which the retractable push button is retracted by screw threaded engagement.

10. The method of securing a portable electronics device of claim 3, in which the outermost head is flush with the rear face when the push button is hidden.

11. The method of securing a portable electronics device of claim 3, in which a cup like member for forming the bore is secured in a hole in the rear wall of the portable electronics device.

12. The method of securing a portable electronics device of claim 3, in which the electronics device is a mobile phone.

13. The method of securing a portable electronics device of claim 3, in which the retractable push button has a shaft with an enlarged head at each end.

14. The method of securing a portable electronics device of claim 3, in which the retractable push button is a close sliding fit in the bore.

15. The method of securing a portable electronics device of claim 3, in which biasing is provided between an inner end of the bore and an inner head of the retractable push button.

16. The method of securing a portable electronics device of claim 3, in which the retractable push button is movable between a retracted position with the outermost head substantially flush with the rear face of the electronics device, and a projecting position where the outermost head extends out of the bore and projects from the rear of the electronics device.

17. The method of securing a portable electronics device of claim 3, in which an outer face of the outermost head provides matching of surface texture of the rear face.

18. The method of securing a portable electronics device of claim 3, in which an outer face of the outermost head provides matching of surface color of the rear face.

19. The method of securing a portable electronics device of claim 3, in which pressing the outermost head inwardly compresses the spring and engages a latching mechanism.

* * * * *